US005979685A

United States Patent [19]

Schütz

[11] Patent Number: 5,979,685

[45] Date of Patent: Nov. 9, 1999

[54] TRANSPORT AND STORAGE CONTAINER FOR LIQUIDS

[75] Inventor: Udo Schütz, Selters-Westerwald, Germany

[73] Assignee: Protechna S.A., Fribourg, Switzerland

[21] Appl. No.: 09/083,768

[22] Filed: May 22, 1998

[30] Foreign Application Priority Data

May 27, 1997 [DE] Germany ..... 197 22 194

[51] Int. Cl.[6] ..... B65D 90/04

[52] U.S. Cl. ..... 220/1.6; 220/9.4; 220/495.06; 220/293

[58] Field of Search ..... 220/1.6, 9.4, 495.06, 220/62.11, 293, 297, 300, 301

[56] References Cited

U.S. PATENT DOCUMENTS

| | | | |
|---|---|---|---|
| 4,676,373 | 6/1987 | Schnziden | 220/9.4 |
| 5,289,937 | 3/1994 | Boots | 220/9.4 |
| 5,437,384 | 8/1995 | Farrell | 220/9.4 |
| 5,653,354 | 8/1997 | Olson | 220/9.4 |
| 5,655,679 | 8/1997 | Schutz | 220/1.6 |
| 5,680,955 | 10/1997 | Schutz | 220/1.6 |

FOREIGN PATENT DOCUMENTS 3819911 7/1992 Germany .

*Primary Examiner*—Joseph M. Moy
*Attorney, Agent, or Firm*—Friedrich Kueffner

[57] ABSTRACT

A transport and storage container for liquids, with a pallet-like underframe, an inner container of synthetic material with four side walls, a bottom wall and a top wall, and a closeable filler connection integrally formed on the top wall, and an outlet connection with a discharge fitting integrally formed in a lower portion of a side wall, an outer casing composed of vertical and horizontal grate rods or constructed as a sheet metal casing, and a removable protective cover of sheet metal or synthetic material fastened to the outer casing and provided with a central entry opening to the filler connection of the inner container which is closeable by a screw cap. Fastening eyes are integrally formed at the top wall of the inner container and slots are arranged in the protective cover for passing therethrough the fastening eyes when fastening the protective cover to the outer casing of the transport container, and securing elements for insertion through the fastening eyes of the inner container which protrude upwardly above the protective cover.

7 Claims, 2 Drawing Sheets

Fig. 3
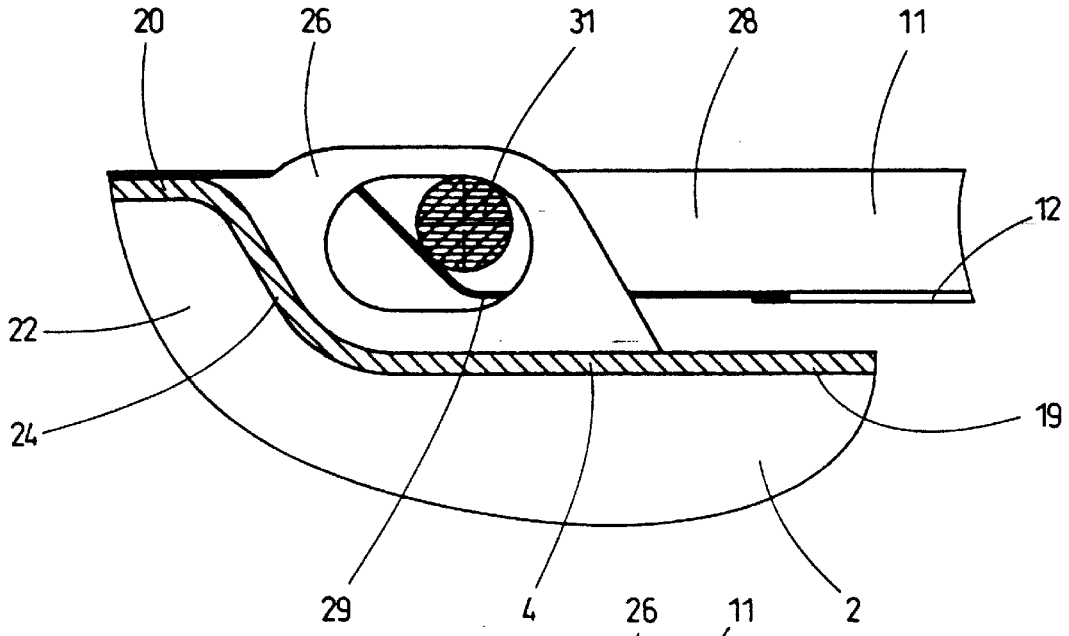
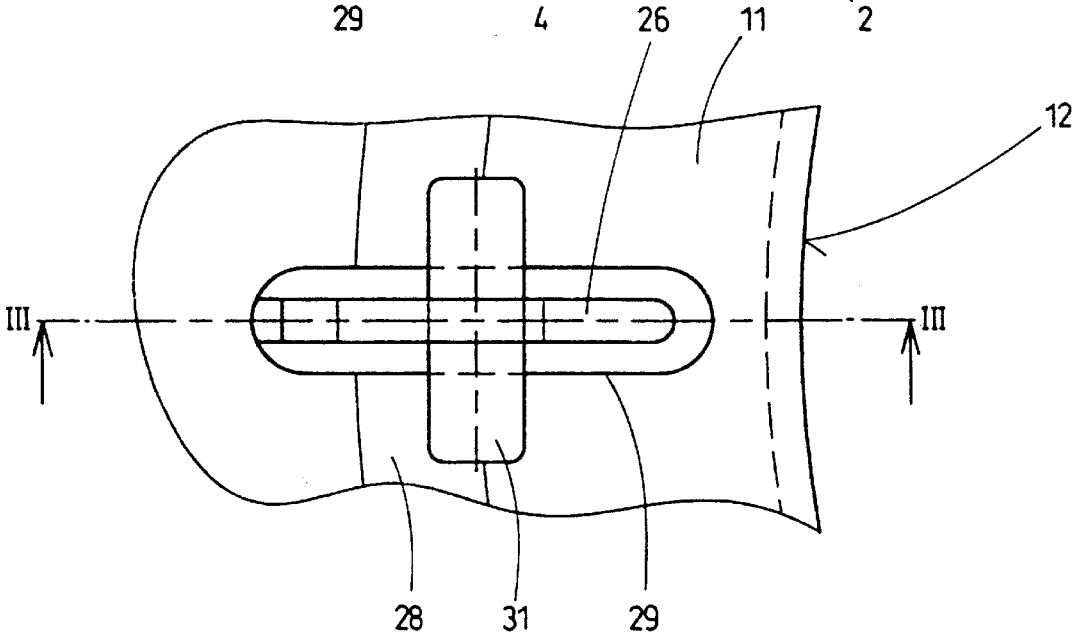
Fig. 2

TRANSPORT AND STORAGE CONTAINER FOR LIQUIDS

BACKGROUND OF THE INVENTION

1. Field of the Invention

The present invention relates to transport and storage containers for liquids, with a pallet-like underframe, an inner container of synthetic material with four side walls, a bottom wall and a top wall, and a closeable filler connection integrally formed on the top wall, and an outlet connection with a discharge fitting integrally formed in a lower portion of a side wall, an outer casing composed of vertical and horizontal grate rods or constructed as a sheet metal casing, and a removable protective cover of sheet metal or synthetic material fastened to the outer casing and provided with a central entry opening to the filler connection of the inner container which is closeable by a screw cap (DE 38 19 911 C2).

2. Description of the Related Art

When these known transport and storage containers are filled with hot liquids and when the liquids subsequently cool, there is the danger that, under the influence of the negative pressure building up in the inner container, the top wall of the inner container of synthetic material is lowered to such an extent that the closing cover of the filler connection integrally formed with the top wall of the inner container can no longer be opened with a commercially available wrench. The danger of lowering of the top wall of the inner container also exists when an agitating mechanism is placed on the filler connection.

SUMMARY OF THE INVENTION

The present invention is based on the object of increasing the stability of the top wall of the inner container of synthetic material in order to avoid a drop of the top wall with the filler connection under the influence of external or internal forces.

In accordance with the invention, this object is met by fastening eyes integrally formed at the top wall of the inner container, slots arranged in the protective cover for passing therethrough the fastening eyes when fastening the protective cover to the outer casing of the transport container, and securing elements for insertion through the fastening eyes of the inner container which protrude upwardly above the protective cover.

By fastening the top wall of the inner container of synthetic material to the protective cover of the transport and storage container, a lowering or a drop of the top wall with the filler connection under the influence of external and internal forces is made impossible. The suspension of the top wall of the inner container at the protective cover of the transport and storage container makes it possible to reduce the wall thickness of the top wall and, thus, to reduce the transport weight of the container and to safe material costs.

The various features of novelty which characterize the invention are pointed out with particularity in the claims annexed to and forming a part of the disclosure. For a better understanding of the invention, its operating advantages, specific objects attained by its use, reference should be had to the drawing and descriptive matter in which there are illustrated and described preferred embodiments of the invention.

BRIEF DESCRIPTION OF THE DRAWING

In the drawing:

FIG. 2 is a partial top view, on a larger scale, of the assembled protective cover of the container with the fastening of the top wall of the inner container of synthetic material to the protective cover, and FIG. 3 is a partial sectional view of the protective cover of the container taken along line III—III of FIG. 2.

DESCRIPTION OF THE PREFERRED EMBODIMENTS

Figure 1:
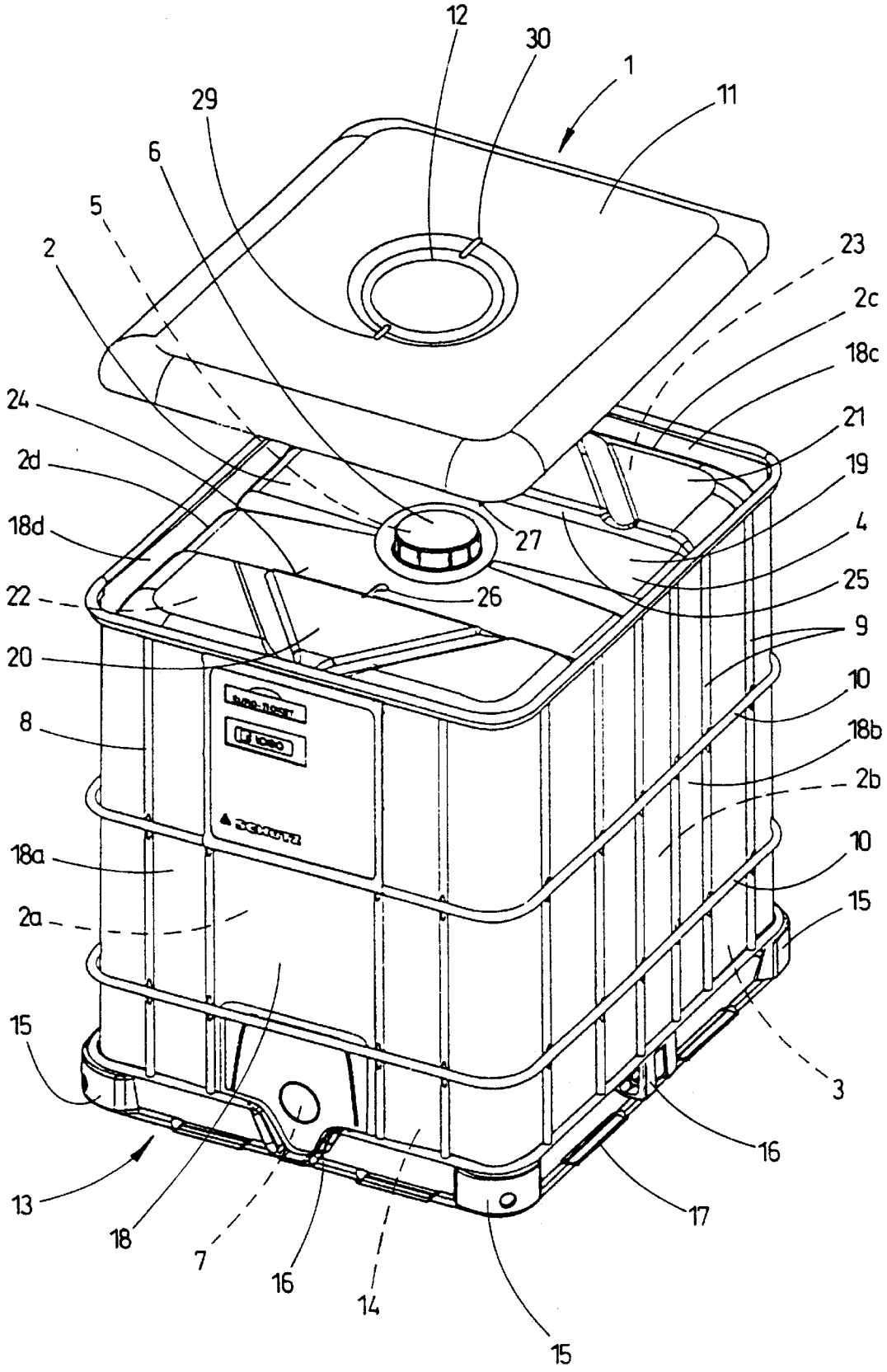
FIG. 1 is a perspective illustration of a transport and storage container.

The transport and storage container 1 for liquids which can be used as a disposable container and a reusable container includes as principal structural components a replaceable parallelepiped inner container 2 of polyethylene with four side walls 2*a*–2*d*, a bottom wall 3 constructed as a draining bottom, an upper wall 4 with an inlet connection 5 and an outlet connection 7 with a drain cock 8, an outer casing 9 of intersecting vertical and horizontal grate rods 10, 11 of metal, a pallet-like underframe 12 with a bottom basin of sheet metal for receiving with frictional engagement the inner container 2 of synthetic material, and a cover 14 of sheet metal for protecting the inner container 2.

The bottom basin 13 rests with a certain bottom clearance on corner and middle legs 15, 16 and a bottom frame 17 or skids, so that the gripping arms of a transport device, for example, a fork lift, can be moved from four sides under the bottom basin 13 for transporting the transport and storage container 1. The legs 15, 16 and the bottom frame 17 or the skids are of metal or an electrically conductive synthetic material, for example, polyethylene with a conductive soot portion. The pallet-like underframe 12 of the transport and storage container 1 has length and width dimensions conforming to European standards.

A support insert 18 with four side walls 18*a*–18*d* is arranged between the inner container 4 of synthetic material and the outer casing 9 of the transport container 1. The single-piece support inert 18 is manufactured by stretching a pipe element of metal on a stretching press.

Electric charges which may possibly occur when filling the transport and storage container with a liquid and when removing liquid from the container 1 due to liquid friction at the surfaces of the inner container 2 of synthetic material are discharged into the ground through the support insert 18, the outer casing 9, the bottom basin 13, the corner and middle legs 15, 18 and the bottom frame 17.

The top wall 4 of the inner container 2 has a middle portion 19 with the filler connection 5 and two raised outer portions 20, 21 which, when the container 2 is filled with a liquid by up to 95%, form hollow spaces 22, 23 in which gas evaporating from the liquid can collect in the case of increased outer temperatures.

Two fastening eyes 26, 27 are integrally formed at the steps 24, 25 between the middle portion 19 and two outer raised portions 20, 21 of the top wall 4 of the inner container 2.

In the area of the indentation 28 of the entry opening 12 of the protective cover 11 of the transport container 1, corresponding slots 29, 30 for passing therethrough the fastening eyes 26, 27 when fastening the protective cover 11 are arranged at the upper ends of the vertical grate rods 9 of the outer casing 8.

For fastening the top wall of the inner container 2 to the protective cover 11 of the transport container 1, pins or bolts 31 of synthetic material or metal are inserted through the fastening eyes 26, 27 which protrude upwardly above the cover.

While specific embodiments of the invention have been shown and described in detail to illustrate the inventive principles, it will be understood that the invention may be embodied otherwise without departing from such principles.

I claim:

1. A transport and storage container for liquids, comprising a pallet-like underframe, an inner container of synthetic material mounted on the underframe, the inner container having four side walls, a bottom wall and a top wall, a closeable filler connection being integrally formed at the top wall and an outlet connection with a discharge fitting being integrally formed at a lower portion of one of the side walls, an outer casing surrounding the inner container, a removable protective cover of metal or synthetic material fastened to the outer casing, the protective cover having a central entry opening for providing access to the filler connection of the inner container, a screw cap for closing the filler connection, further comprising fastening eyes integrally formed at the top wall of the inner container and protruding upwardly above the protective cover, slots being defined in the protective cover for passing therethrough the fastening eyes when fastening the protective cover to the outer casing, and securing elements for insertion through the fastening eyes of the inner container.

2. The container according to claim 1, wherein the outer casing is composed of vertical and horizontal grate rods.

3. The container according to claim 1, wherein the outer casing is comprised of sheet metal.

4. The container according to claim 1, wherein the securing elements are bolts of synthetic material or metal configured to be inserted through the fastening eyes of the inner container for fastening the top wall of the inner container to the protective cover.

5. The container according to claim 1, wherein the top wall of the inner container has steps between a middle portion and outer raised portions of the top wall, and wherein the fastening eyes are integrally formed at the steps.

6. The container according to claim 1, further comprising a support insert having four side walls, the support insert being mounted between the side walls of the inner container and the outer casing, and wherein the support insert is composed of an electrically conductive material.

7. The container according to claim 6, wherein the electrically conductive material is metal.

* * * * *